United States Patent [19]

Baker et al.

[11] 4,261,540

[45] Apr. 14, 1981

[54] HEIGHT ADJUSTABLE CHAIR BASE

[75] Inventors: Richard H. Baker, Grand Rapids; Bernard J. Fries, Jenison, both of Mich.

[73] Assignee: Steelcase, Inc., Grand Rapids, Mich.

[21] Appl. No.: 915,665

[22] Filed: Jun. 15, 1978

[51] Int. Cl.[2] ..... F16M 11/00

[52] U.S. Cl. ..... 248/406

[58] Field of Search ..... 248/405, 406

[56] References Cited

U.S. PATENT DOCUMENTS

| | | | |
|---|---|---|---|
| 593,059 | 11/1897 | Sheriffs et al. | 248/406 |
| 657,981 | 9/1900 | Germanson | 248/405 X |
| 682,844 | 9/1901 | Ellenbecker | 248/405 X |
| 1,316,621 | 9/1919 | Loeffler | 248/406 |
| 1,334,660 | 3/1920 | Loeffler | 248/406 |
| 1,399,465 | 12/1921 | Collier | 248/405 UX |
| 1,928,801 | 10/1933 | Uhl | 248/405 |
| 2,026,298 | 12/1935 | Bouman | 248/405 X |
| 2,587,886 | 3/1952 | Penchoen | 248/188.7 |
| 3,788,587 | 1/1974 | Stemmler | 248/404 X |
| 3,870,271 | 3/1975 | Bowman | 248/406 |
| 3,991,965 | 11/1976 | Westover | 248/406 |
| 4,026,509 | 5/1977 | Wolters | 248/406 |
| 4,087,070 | 5/1978 | Hancock | 248/406 |

FOREIGN PATENT DOCUMENTS

| | | | |
|---|---|---|---|
| 687506 | 1/1940 | Fed. Rep. of Germany | 248/406 |
| 1029020 | 5/1966 | Fed. Rep. of Germany | 248/406 |

*Primary Examiner*—William H. Schultz

*Attorney, Agent, or Firm*—Price, Heneveld, Huizenga & Cooper

[57] ABSTRACT

A rotatable and vertically adjustable chair base is disclosed comprising a floor engaging stand, an upstanding tubular post mounted on the stand, a threaded member received by the tubular post and a smooth spindle slidably and rotatably received by the upstanding tubular post. Internal threads are provided in the upstanding tubular post with a split sheet metal sleeve carrying stamped metal threads. The stamped metal threads of the sheet metal sleeve are engaged by a plastic threaded member which takes advantage of the relatively low coefficient of friction between plastic and metal. The spindle rides atop the threaded member, the vertical position of the spindle being determined by the position of the threaded member. Vertical adjustment of the spindle and the chair mounted atop the spindle is achieved with detent means for alternately engaging and disengaging the threaded member. When the chair is unoccupied, the spindle engages the threaded member and is vertically adjustable by rotation of the chair. Under the weight of an occupant the spindle automatically disengages from the threaded member to allow the occupied chair to freely rotate without vertical adjustment of the spindle.

11 Claims, 11 Drawing Figures

HEIGHT ADJUSTABLE CHAIR BASE

BACKGROUND OF THE INVENTION

This invention relates generally to chair bases and chair height adjustment mechanisms. In particular, the invention is directed to a reliable and inexpensive chair base and height adjusting mechanism of the type that is automatically adjustable by rotation of the chair whenever the chair is unoccupied.

A number of different arrangements have been provided to enable the user of a swivel chair to selectively adjust the height of a chair. The most prevalent prior art designs employ a threaded spindle and nut combination that is vertically adjustable on a floor engaging base. In earlier mechanisms the nut is permanently fixed relative to the floor engaging base so that rotation of the chair seat and its spindle produces a raising or lowering of the spindle and chair seat. The disadvantages of such a construction are apparent since it follows that whenever the chair seat is swivelled, either intentionally or accidentally, the height of the chair seat is altered.

Another arrangement involves the use of a floating spindle nut which precludes vertical displacement of the spindle except when the user manually engages the nut and positively rotates the nut or the seat to raise or lower the spindle extending therethrough. This arrangement is inconvenient since the user must reach under the seat and manually hold or turn the nut relative to the spindle. Other disadvantages common to both of these related forms of chair height adjusting mechanisms include limited adjustment ranges and the fact that the threaded spindle and spindle nut are costly to machine and must be lubricated. The lubricated spindle and nut are exposed to the collection of dirt, dust and lint which further impede manual adjustment of the chair, often soil the user of the chair, and in general detract from the aesthetic appearance of the chair.

Numerous alternatives to this traditional type of chair adjustment arrangement have been suggested in the prior art. These arrangements include telescoping tubular columns wherein height adjustment is effected by a hand lever engaging or disengaging slots, balls, wedging washers, garter springs, or expanding collars to effect height adjustment of the telescoping tubular columns. Gas cylinders and hand operated pumps have also been employed. Of all of these alternative designs, the most appealing from the users point of view is a type of automatic chair height adjusting mechanism that engages whenever the chair is unoccupied. With this type of chair height adjustment mechanism the chair seat may be vertically adjusted by simple rotation of the unoccupied chair. When the chair is occupied the chair adjustment mechanism automatically disengages to allow the chair to freely rotate without vertical adjustment. However, this type of automatic chair height adjusting mechanism, along with the other alternative designs tend to be complex and costly to manufacture.

SUMMARY OF THE INVENTION

In the present invention, an extremely economical yet highly attractive automatically adjustable chair base is achieved by placing a split, stamped, threaded sheet metal sleeve within the hollow tubular column of the chair base. Thus, costly machined threads are eliminated. A smooth chair engaging spindle is slidably and rotatably received within the upstanding tubular column and rests upon a threaded member received within the tubular post. The vertical position of the spindle is determined by the position of the threaded member within the tubular post. By virtue of the fact that neither the tubular post or the smooth spindle include external threads, the chair adjustment mechanism of the present invention suffers from none of the disadvantages of traditional chair adjustment mechanisms and provides an aesthetically pleasing appearance.

On a preferred aspect of the invention, detent means is provided for spring biasing the spindle into engagement with the underside of the threaded member when the chair is unoccupied. With detent means engaged the spindle and the threaded member rotate as one member. Thus, vertical adjustment of the spindle and the chair is automatically achieved by rotation of the unoccupied chair. The detent means automatically disengages under the weight of the occupant in the chair and thus the occupied chair is allowed to freely rotate without vertical adjustment of the spindle. These and other objects, advantages and features of the present invention will be more fully understood and appreciated by reference to the written specification and appended drawings.

DESCRIPTION OF THE PREFERRED EMBODIMENTS

Figure 1:
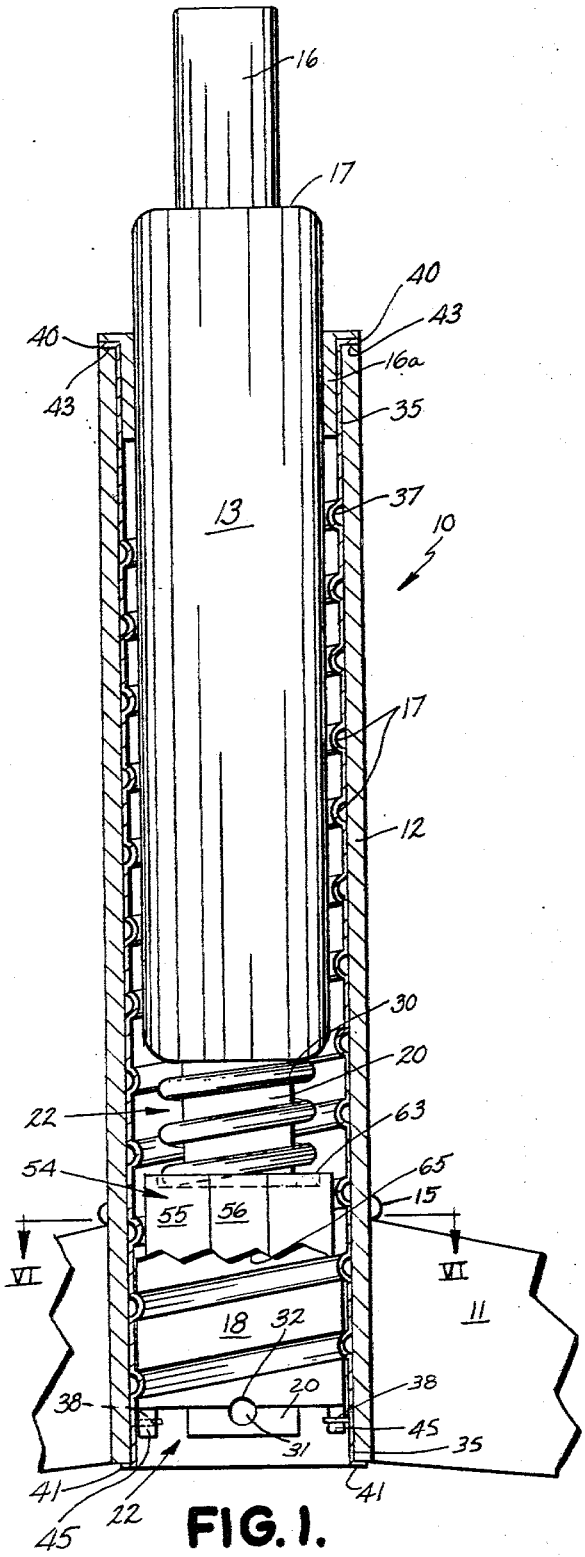
FIG. 1 is an elevational view, partially in section, of a chair support constructed according to the present invention.

Referring to FIG. 1, the chair base, generally indicated by numeral 10, comprises floor engaging supports or arms 11, an upstanding tubular post 12 joined thereto, and a smooth spindle 13 slidably and rotatably received in the upstanding tubular post 12. A circumferential rib 15 is disposed about tubular post 12, and serves to strengthen the juncture of arms 11 to tubular post 12. The spindle 13 includes a first spindle shaft 16 and a shoulder 17 securing a chair seat or a tilting chair control to spindle 13 in any suitable manner. The upstanding tubular post 12 and the telescoping spindle 13 are both provided with smooth exterior surfaces to obviate the problems heretofore experienced with chair adjustment mechanisms having external threads and to provide a chair adjustment mechanism having a pleasing aesthetic effect.

The upstanding tubular post 12 further includes a plastic bearing insert 16a for slidably and rotatably receiving spindle 13. The tubular post 12 is lined with a split, stamped sheet metal inner sleeve 35 which is stamped to define internal threads at 17. A threaded member 18 is received by the internal threads of tubular post 12 and the spindle 13 rests atop threaded member 18. The vertical position of the spindle 13 is determined by the position of threaded member 18 within upstanding tubular post 12. The threaded member 18 includes an axial bore not shown in FIG. 1. The spindle 13 includes a second spindle shaft 20 extending through threaded member 18 and axially centering the spindle 13.

Detent means generally indicated at 22 is provided for spring biasing the spindle 13 into engagement with threaded member 18 when the chair is unoccupied. When the detent means is engaged, the spindle 13 and threaded member 18 rotate as one. The threaded member 18 moves up or down in upstanding tubular post 12 depending on the direction of rotation. Thus, the chair adjustment mechanism is automatically vertically adjustable by rotation of the unoccupied chair. The detent means 22 disengages under the weight of an occupant in the chair so that the chair may freely rotate without vertical adjustment of the spindle.

The detent means 22 comprises a spring 30 disposed about, downwardly projecting, second spindle shaft 20 and compressed between the spindle 13 and threaded member 18. A post 31 extends radially from the second spindle shaft 20 below threaded member 18. One or more notches such as the one illustrated at 32 on the bottom of threaded member 18 are provided for receiving the post 31. The spring 30 is provided with a predetermined strength greater than the weight of the spindle 13 and the chair mounted thereon, but less than the weight of the spindle 13, the chair mounted thereon and the weight of an occupant. Thus, when the chair is unoccupied, the spring 30 lifts the spindle and chair 13, spring biasing post 31 into engagement with notch 32 on the underside of threaded member 18. However, when the chair is occupied, the additional weight of the occupant compresses spring 30 between spindle 13 and threaded member 18, moving the post 31 downward, out of engagement with notch 32 on the bottom of threaded member 18.

Figure 2:
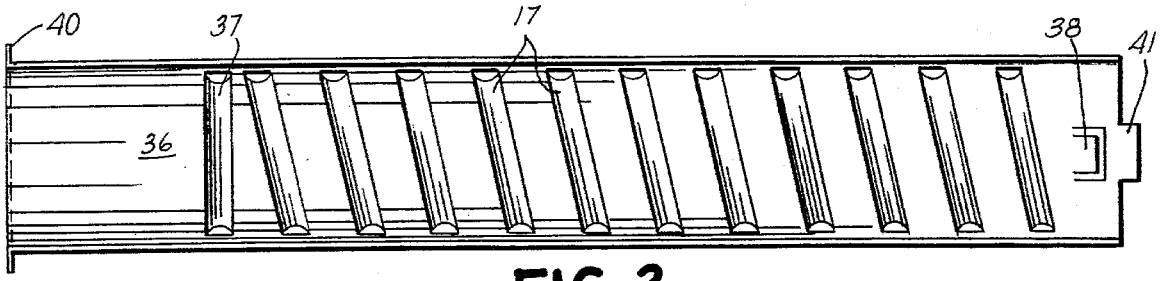
FIGS. 2 and 3 are plane views of split sleeve halves employed in the chair support of the present invention.

The cost of the chair adjustment mechanism 10 illustrated in FIG. 1, is greatly reduced by the fact that neither the upstanding tubular post 12 nor the threaded member 18 include machined threads. The threads 17 on the inside of upstanding tubular post 12 are stamped metal threads carried on a split metal sleeve 35. The split metal sleeve 35 is comprised of sleeve halves 36, better illustrated in FIGS. 2 and 3. In addition to stamped metal threads 17, sleeve halves 36 include an inwardly directed stamped metal ridge 37. The metal ridge 37 is disposed at the top of threads 17 to engage threaded member 18 and define its uppermost limit of travel. A lanced tab 38 is provided at the bottom of sleeve halves 36 to define the lower limit of travel of threaded member 18. The sleeve halves 36 further include a flange 40 disposed at the top of each sleeve half and a deformable tab 41 disposed at the bottom of each sleeve half.

Referring specifically to FIG. 1, sleeve halves 36 are assembled within upstanding tubular post 12 by insertion of sleeve halves 36 through the top of tubular post 12 until flanges 40 engage the top edge 43 of tubular post 12. Plastic bearing 16 is then inserted in the top of tubular post 12, ensuring that the sleeve halves 36 and flanges 40 adhere to the top of tubular post 12. Deformable tabs 41 are then bent around the bottom edge 44 of upstanding tubular post 12. Threaded member 18 may then be threadably received within upstanding tubular post 12 and spindle 13 and detent means 22 secured thereto by insertion of radial post 31 which may conveniently be a rollpin. Lanced tabs 38 may then be bent up as illustrated in FIG. 1 to form stops defining the lowermost limit of travel for threaded member 18 by engagement with lugs 45 on threaded member 18. After assembly of the chair base a decorative tube may be secured to the outside of upstanding tubular post 12 in any suitable manner.

Figure 4:
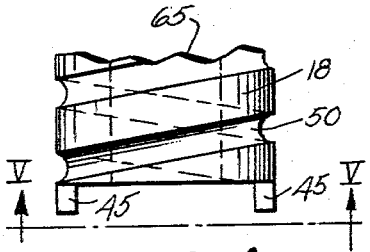
FIG. 4 is an elevational view of a threaded member employed in the chair support of the present invention.
Figure 5:
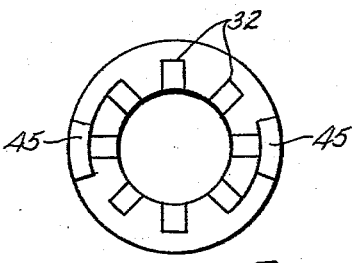
FIG. 5 is a view of the threaded member of FIG. 4, taken along line V—V in FIG. 4.

Referring now to FIG. 4, threaded member 18 is illustrated in further detail. Costly machine threads are avoided on threaded member 18 by injection molding threaded member 18 from a suitable plastic. Thus the threads 50, carried on the exterior of threaded member 18 are molded in situ. Another advantage flowing from the use of plastic and metal mating threaded members includes the lower coefficient of friction between plastic and metal. This lower coefficient in friction yields ease in operation and allows the use of coarser threads providing a higher adjustment ratio.

Figure 3:
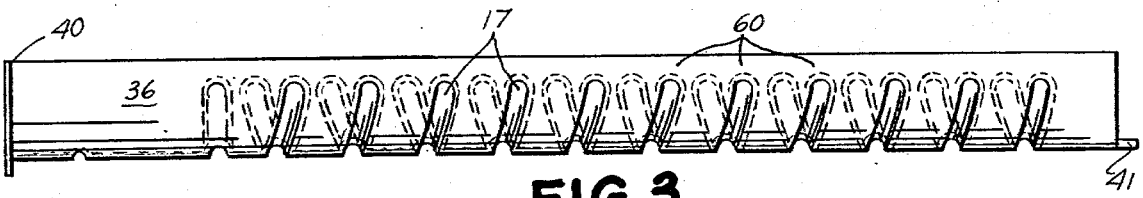
Figure 6:
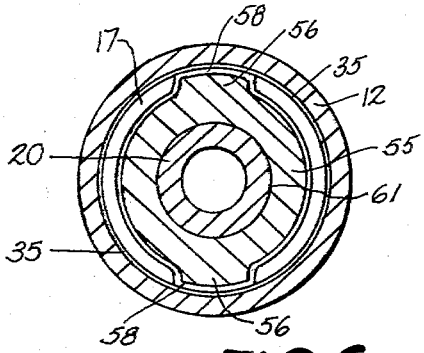
FIG. 6 is a sectional view of a brake washer employed in the chair support of the present invention taken along line VI—VI of FIG. 1.

Referring now back to FIG. 1, and to FIGS. 3, 4 and 6, it is illustrated that the chair adjustment mechanism includes brake means 54 for ensuring that threaded member 18 does not rotate when the chair is occupied. In this case, brake means 54 comprises a brake washer 55 disposed between the threaded member 18 and spindle 13. Brake washer 55 includes ears 56 extending from the circumferential surface thereof. The ears 56, best illustrated in FIG. 6, engage channels 58 running the length of sheet metal sleeve 35. The channels 58 running the length of sheet metal sleeve 35 are formed from a linear array of discontinuities provided in the stamped metal threads 17. This array of discontinuities is best illustrated at 60 on sleeve half 36 illustrated in FIG. 3. Brake washer 55 includes a bore 61 through which second spindle shaft 20 of spindle 13 extends. The top of brake washer 54 includes an annular groove 63 in which spring 30 is seated. The underside of brake washer 54 and the top of threaded member 18 include a series of undulations providing mating male and female members at 65. The male and female members 65 firmly interlock when the brake washer and threaded member 18 are urged together under the weight of an occupant in the chair. With ears 56 of brake washer 55 engaging channels 58 in sleeve 35, both the brake washer 55 and threaded member 18 are firmly secured against rotation within upstanding tubular post 12. The top of brake washer 55 is provided with a relatively smooth surface to ensure unimpeded rotation of the spindle 13. However, since the male and female members 65 are formed from a series of relatively smooth undulations, relative movement between the brake washer 55 and the threaded member 18 is provided when the interface between the brake washer and threaded member is lightly loaded. Thus, when the chair is unoccupied, and the detent means 22 firmly engages threaded member 18 and spindle 13, threaded member 18 is free to rotate with spindle 13.

Figure 7:
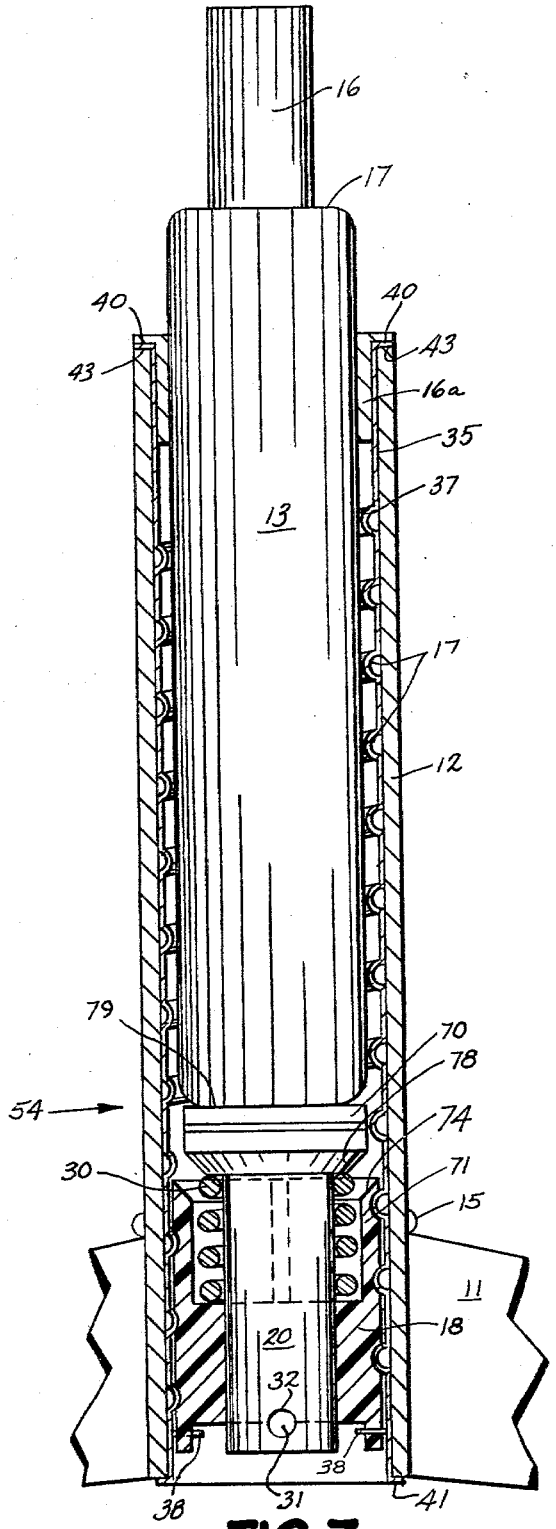
FIG. 7 is an elevational view partially in section of another embodiment of the invention.

Referring now to FIG. 7, another embodiment of the invention is illustrated. The principle difference between the embodiment of FIG. 7 and that of FIG. 1 is in the brake means for ensuring that vertical adjustment of the spindle does not occur upon rotation of an occupied chair. Thus, there are many similar components in the embodiments of FIG. 1 and FIG. 7 and like components are given the same numeral designation. In the embodiment of FIG. 7 the chair support is provided with brake means generally indicated at 54 comprising a friction clutch disposed between the spindle 13 and the threaded member 18. The friction clutch 54 engages to prevent rotation of the threaded member 18 under the weight of an occupant in the chair and disengages when the chair is empty to allow the threaded member 18 to freely rotate.

Figure 9:
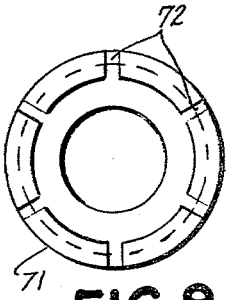
FIG. 9 is a top view of the threaded member of FIG. 8 taken along line IX—IX of FIG. 8.
Figure 8:
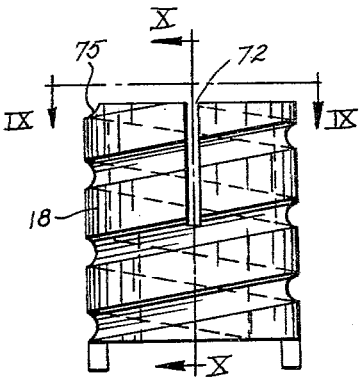
FIG. 8 is an elevational view of a threaded member employed in the embodiment of the invention illustrated in FIG. 7.
Figure 10:
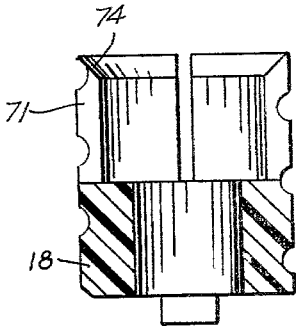
FIG. 10 is a sectional view of the threaded member of FIG. 8 taken along line X—X of FIG. 8.

Referring now also to FIGS. 8, 9, and 10, the friction clutch 54 will be described in further detail. The friction clutch 54 comprises a wedge washer 70 disposed between threaded member 18 and spindle 13. Wedge washer 70 includes a central aperture through which second spindle shaft 20 extends. In this case, the friction clutch further includes an upwardly projecting split tubular portion 71 disposed on threaded member 18. Tubular portion 71 is rendered somewhat resilient in that its thickness is somewhat reduced from the thickness of the body portion of the threaded member 18 and it is provided with a plurality of splits or slots 72 best illustrated in FIGS. 8 and 9. Upstanding split tubular portion 71 further includes a first frustoconical cam surface 74 disposed on the top edge 75 of split tubular portion 71. A second frustoconical cam surface 78 is provided on the underside of wedge washer 70. Compression spring 30 is disposed between wedge washer 70 and threaded member 18 within the split tubular portion 71 of threaded member 18.

In the operation of the friction clutch 54, when the chair is unoccupied the spring 30 separates first and second frustoconical cam surfaces 74 and 78. However, under the weight of an occupant in the chair the spring 30 is overcome and first and second frustoconical cam surfaces 74 and 78 are urged together. This expands the relatively resilient split tubular portion 71 of threaded member 18 into firm frictional engagement with the metal sleeve 35. Thus, under the weight of an occupant in the chair, the threaded member 18, in addition to being disengaged from spindle 13 is firmly secured against rotation within tubular member 12. When the weight of the occupant is removed, spring 30 biases wedge washer 70 upward along the spindle 13, separating first and second frustoconical cam surfaces 74 and 78 and releasing threaded member 18.

Figure 11:
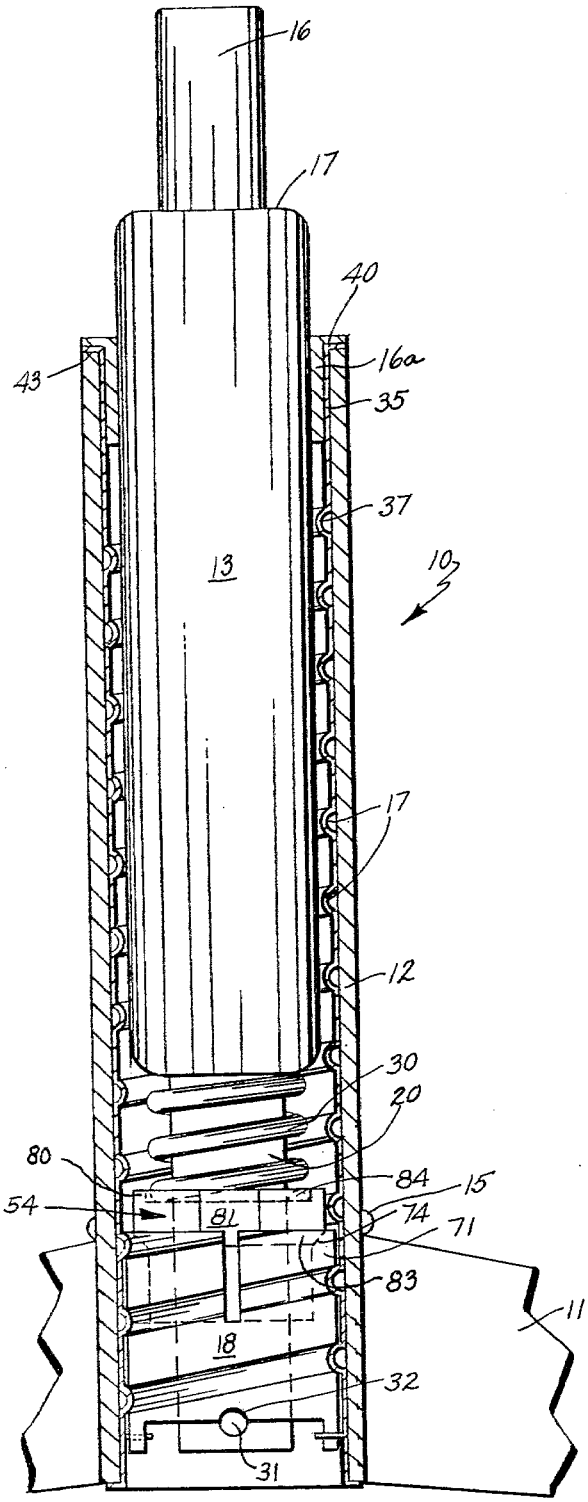
FIG. 11 is an elevational view partially in section of another embodiment of the invention.

FIG. 11 illustrates still another embodiment of the invention. The embodiment of FIG. 11 is very similar to that of FIGS. 1 and 7 except that it includes a brake means generally indicated at 54 combining features of the brake means of FIGS. 1 and 7. Again, like components are given the same numeral designation. In FIG. 11, the brake means 54 is a friction clutch including a threaded member 18 having an upwardly extending split tubular portion 71 including a first frustoconical cam surface 74. The threaded member 18 including frustoconical surface 74 cooperates with a wedge washer 80, including ears 81 and second frustoconical cam surface 83. Like the brake washer of the embodiment of FIG. 1, the ears 81 of wedge washer 80 cooperate with a channel extending the length of sleeve 35 formed from a series of discontinuities in the stamped metal threads formed thereon. The wedge washer 80 is disposed on second spindle shaft 20 between spindle 13 and threaded member 18. Coil spring 30 is disposed between spindle 13 and brake washer 80. The brake washer 80 further includes an annular groove 84 in which coil spring 30 rests. The top of brake washer 80 is relatively smooth to ensure relative rotation when necessary between the spindle 13 and brake washer 80.

In the operation of the friction clutch illustrated in FIG. 11, the first and second frustoconical cam surfaces 74 and 83 are in constant engagement. However, the weight of the spindle 13 and the chair mounted thereon are insufficient to firmly cam the resilient tubular portion 71 of threaded member 18 into firm frictional engagement with metal sleeve 35 of upstanding tubular post 12. Thus, when the chair is unoccupied, and the spindle 13 is firmly engaged to threaded member 18, threaded member 18 is free to rotate and vertically adjust the height of spindle 13. However, under the weight of an occupant in the chair, first frustoconical cam surfaces 74 and 83 cam the resilient walls of tubular portion 14 outward into firm frictional engagement with sleeve 35 of upstanding tubular post 12 securing threaded member 18 from any possible movement.

It should be apparent from the above description that the present invention presents a relatively simple and economic chair adjustment mechanism of the type which is automatically adjustable upon rotation of an unoccupied chair mounted thereon. The cost of manufacture is principally reduced by the elimination of machined threads and the simplicity of the design which lends to ease in assembly. Use of metal and plastic threaded members reduces the coefficient of friction providing ease in operation and a higher adjustment ratio. The design itself provides a wider range of adjustment than ever possible with the traditional type of threaded spindle chair adjustment mechanisms. However, the cost of manufacture is much lower than newer alternative types of chair adjustment mechanisms. The chair adjustment mechanism of the present invention is quite reliable due to a multi-function design and the fact that there is constant thread engagement.

The above description should be considered as exemplary and that of the preferred embodiment only. It is desired to include within the scope of the invention all such modifications of the invention that come within the legitimate scope of the appended claims.

The embodiments of the invention in which an exclusive property or privilege is claimed are defined as follows.

1. A rotatable and vertically adjustable chair base comprising:

floor engaging means;

an upstanding tubular post mounted on said floor engaging means;

a sheet metal sleeve comprised of two separate halves, separately stamped to define stamped metal threads;

said sheet metal sleeve halves being mounted in said post on opposite sides thereof;

a plastic threaded member threadably received in said sheet metal sleeve;

a smooth spindle for attachment to a chair, said spindle resting atop said threaded member;

a bore axially centered in said threaded member;

a shaft axially centered on the bottom of said spindle said shaft registering with and extending through said cylindrical bore;

said spindle being slidably and rotatably received by said tubular post, the vertical position of said spindle being determined by the position of said threaded member; and means for selectively engaging or disengaging said spindle and said threaded member whereby when engaged, said spindle and said threaded member rotate together, said threaded member threading within said sheet metal sleeve, and whereby when disengaged, said spindle rotates independently of said threaded member; said means for selectively engaging including a spring means disposed about said shaft and compressed between said spindle and said threaded member, detent means extending radially from said shaft below said threaded member, means for receiving said detent means disposed in the bottom of said threaded member, and said spring having a predetermined spring strength greater than the weight of the spindle and the chair but less than the weight of the spindle, chair and an occupant whereby said post is biased upward into engagement with said receiving means by said spring when the chair is unoccupied and said detent means is released downward from said receiving means when the chair is occupied.

2. The chair base of claim 1 further including brake means for ensuring that said threaded member does not rotate when the chair is occupied.

3. The chair base of claim 2 wherein said brake means comprises:

a channel running the length of said sheet metal sleeve, said channel being formed from a linear array of discontinuities provided in said stamped metal threads;

a brake washer disposed between said threaded member and said spindle;

an ear disposed on said brake washer, said ear engaging said channel to prevent rotation of said brake washer; and mating male and female members disposed on said brake washer and said threaded member, said male and female members firmly interlocking said brake washer and said threaded member under the weight of an occupant in the chair, said male and female members providing for relative rotation between said brake washer and said threaded member when the chair is unoccupied and said detent means biases said spindle into engagement with said threaded member.

4. The chair base of claim 2 wherein said brake means comprises a friction clutch disposed between said spindle and said threaded member, said friction clutch engaging to prevent rotation of said threaded member under the weight of an occupant in the chair.

5. The chair base of claim 4 wherein said friction clutch comprises:

an upwardly projecting split tubular portion disposed on said threaded member;

a first frustoconical cam surface disposed on the top edge of said split tubular portion;

a wedge washer disposed between said threaded member and said spindle; and a second frustoconical cam surface disposed on the bottom of said wedge washer, said second frustoconical cam surface being urged into engagement with said first frustoconical cam surface, expanding said split tubular portion into frictional engagement with said metal sleeve under the weight of an occupant in the chair.

6. The chair base of claim 5 further including:

a channel running the length of said sheet metal sleeve, said channel being formed from a linear array of discontinuities provided in said stamped metal threads; and an ear disposed on said wedge washer, said ear engaging said channel to prevent rotation of said brake washer.

7. The chair base of claim 6 wherein said wedge washer is disposed between said threaded member and said spring, said wedge washer and said spring being disposed between said spindle and said threaded member.

8. The chair base of claim 5 wherein said wedge washer is disposed between said spindle and said spring, said wedge washer and said spring being disposed between said spindle and said threaded member.

9. The chair base of claims 1, 2, 3, 5 or 6 wherein said split sheet metal sleeve includes upper and lower stop means for defining the limits of travel of said threaded member, said upper stop means comprises a stamped, inwardly projecting, circumferential ridge defined by said split sheet metal sleeve.

10. The chair base of claim 9 wherein said lower stop means comprises at least one lanced tab disposed on the bottom of said split sheet metal sleeve, said lanced tab being bent inwardly after insertion of said threaded member, said lower stop means further including at least one downwardly projecting lug disposed on the bottom of said threaded member, said lug cooperating with said tab to define the lower limit of travel of said threaded member.

11. The chair base of claim 9 comprising:

a circumferential flange disposed at the top of each said sheet metal sleeve half for engaging the top of said upstanding tubular post; and a deformable tab disposed at the bottom of each said sheet metal sleeve half for engaging the bottom of said upstanding tubular post whereby said halves are secured in said post.

* * * * *

UNITED STATES PATENT AND TRADEMARK OFFICE

CERTIFICATE OF CORRECTION

PATENT NO. : 4,261,540

DATED : April 14, 1981

INVENTOR(S) : Richard H. Baker
Bernard J. Fries

It is certified that error appears in the above-identified patent and that said Letters Patent are hereby corrected as shown below:

Column 4, line 43:

"54" should be --55--

Column 4, line 44:

"54" should be --55--

Column 4, line 66:

"principle" should be --principal--

Signed and Sealed this

Eleventh Day of August 1981

[SEAL]

Attest:

GERALD J. MOSSINGHOFF

Attesting Officer

Commissioner of Patents and Trademarks